United States Patent [19]

Winders et al.

[11] 3,932,970

[45] Jan. 20, 1976

[54] BUILDING

[76] Inventors: John D. Winders, 26 Chantry Hurst, Epsom, Surrey; Marian F. Grzesik, 26/28 Hillcroft Crescent, Ealing, London, W. 5, both of England

[22] Filed: Oct. 7, 1974

[21] Appl. No.: 512,873

Related U.S. Application Data

[63] Continuation of Ser. No. 344,764, March 26, 1973, abandoned.

[30] Foreign Application Priority Data

Mar. 27, 1972 United Kingdom ..... 14296/72

[52] U.S. Cl. ..... 52/169; 52/185; 52/228; 52/236; 52/745

[51] Int. Cl.[2] ..... E04H 1/00; E04B 1/342

[58] Field of Search ..... 52/79, 86, 90, 91, 169, 52/182, 185, 741, 745, 223, 228, 236

[56] References Cited

UNITED STATES PATENTS

| | | | |
|---|---|---|---|
| 3,535,835 | 10/1970 | Kupper | 52/79 |
| 3,623,296 | 11/1971 | Santoro | 52/79 |
| 3,721,056 | 3/1973 | Toan | 52/79 X |
| 3,724,147 | 4/1973 | Levensen | 52/79 X |
| 3,791,081 | 2/1974 | Felciai | 52/79 |

FOREIGN PATENTS OR APPLICATIONS

| | | | |
|---|---|---|---|
| 1,034,101 | 6/1966 | United Kingdom | 52/236 |

OTHER PUBLICATIONS

Civil Engineering–ASCE, Jan. 1973, pp. 70–73.

*Primary Examiner*—Alfred C. Perham
*Attorney, Agent, or Firm*—Brisebois & Kruger

[57] ABSTRACT

A multi-storey building is erected over an appreciable area on which it is either not desired or possible to build directly. The building consists essentially of a load bearing frame which spans the area without any intermediate supports and on which the storeys of the building are erected. The frame comprises a number of axially spaced arches and two series of staggered giant steps between each pair of neighbouring arches, the two series being on opposite sides of the apex of the frame and each step being formed by at least one concrete slab and being fixed to its adjacent arches. The storeys of the building are formed by a large number of individual accommodation units which are erected on both sides of the frame. Each accommodation unit is formed in part by one or the giant steps, and usually, each unit will be overlapped to some extent by the unit which is erected on the next step up the frame so that the storeys will appear to be generally staggered up each side of the frame towards the apex. The frame is pitched so that almost the whole of the weight of the accommodation units is borne by the frame.

14 Claims, 13 Drawing Figures

BUILDING

This is a continuation of application Ser. No. 344,764, filed Mar. 26, 1973, now abandoned.

In many places, particularly some urban areas, the scarcity, and consequently the cost, of building land has become quite a problem. The ideas of building over areas which are unsuitable for building on directly, and of making double use of areas by building over them in order to allow the areas to be used at ground level for other purposes, would seem to be ways of easing the problem. For example, railways and in particular wide railway complexes, motorways and other main roads, and rivers, all of which may be in use, could be built over without materially affecting their continued use. Alternatively, clear areas may be built over so as to leave a large part of the area free to be used for some additional purpose in the future. Any schemes for implementing these ideas in a practical manner must however take into account safety and cost, and, when the area being built over is already in use, the ability to construct the building with little or no interference in the use of the area covered.

With this in mind, according to the present invention, a multi storey building over an area on which it is not desired or not possible to build directly, comprises a load bearing structural frame spanning the area and comprising at least two axially spaced arches and a number of slabs which extend between the arches or each pair of neighbouring arches and which form a series of staggered steps up at least one side of the frame, each step being fixed to its adjacent arches, and a number of accommodation units erected on the frame to form the storeys of the building, each accommodation unit being formed in part by one of the steps. In referring to the sides of the frame, we refer to the faces of the frame on opposite sides of the line through the apices of the arches.

It is quite feasible to build the structural frame so that it will support its own weight plus the weight of the accommodation units erected upon it without requiring any vertical thrust support other than at the feet of the arches, even though the span of the building may be great. This requirement is particularly necessary when building over railway complexes and roads. Furthermore it is possible to build the frame (as will be described later) with very little interference in the normal use of the area being spanned, and once erected, the frame is self-supporting (the steps helping to provide axial restraint) and allows the rest of the building to be erected without any interference at all in the area being spanned.

With no vertical support within the area spanned, the weight of the building is taken by the arches and is translated into a vertical thrust and a horizontal outwardly directed thrust. The vertical thrust is taken mainly by foundations at the feet of the arches, whereas the horizontal thrust may be accommodated by passive earth resistance if conditions are suitable, for example when the building is constructed between the banks of a railway cutting, by thrust bored ties which extend below ground between the feet of each arch, by raked piles sunk into the ground, or by a suitable combination of any of these methods.

In principle each arch is like a portal frame, and is preferably a three hinged construction (at each foot and at the apex) although two hinged or fixed arch constructions may be used provided the arches are suitably stressed. Each arch may have a curved profile, but usually it will have an inverted substantially V-shaped profile, which may or may not be symmetrical about the apex.

The arches may be made of any suitable structural material, but preferably they are concrete constructions, each arch being formed in two parts which are connected together at the apex, and each part comprising a number of pre-cast sections which are fixed end-to-end and are subsequently post tensioned. The two parts of each arch may be erected in situ so that they meet at the apex of the arch, or alternatively they may be erected on site but out of position, being moved into position and connected together at the apex of the arch after each part has been post tensioned.

The slabs which form the steps of the frame are preferably reinforced or pre-stressed pre-cast concrete slabs, and are fixed at their ends to nibs which project from the vertical faces of the arches. The slabs may be grouted to the nibs, using shear connectors which may be straight forward bolted joints or grouted in situ joints using bars protruding from the arches. Although the steps may be formed simply by a series of horizontal platforms, each of which comprises one or more horizontal slabs, each step preferably comprises a horizontal platform and a vertical web, both the platform and the web being fixed to the adjacent arches. This arrangement increases the rigidity, and hence the stability of the frame. Preferably the lower edge of the web of each step lies adjacent the inner edge of the platform, and the upper edge of the web lies adjacent the outer edge of the platform of the next step so that the steps between the arches of the frame are continuous. Usually, steps are provided on both sides of the frame.

An arrangement of the arches and the continuous concrete steps extending between the arches on each side of the frame forms a load bearing structural frame which spans and completely covers the area to be built over, and enables the remainder of the building to be erected without any interference whatsoever in the area covered. As explained earlier, the frame itself may also be erected with little or no interference in the area being covered. In one method of construction the arches are erected one at a time, the sections of each part of the arch under erection being positioned and fixed together in situ over a temporary platform which supports the construction and shields the area being built over. The platform may be suspended from a gantry crane which spans the area and which is also used to hoist the arch sections into place. When an arch is completed the crane and the platform are moved so that they can be used in the erection of a further arch. A gantry crane and support platform suitable for use in this method are described in British Application No. 14296/72, in the name of C. H. Dobbie and Partners.

Alternatively, each arch may be erected by assembling the two parts vertically, each within its own support gantry constructed around a mounting block for the foot of the arch part. After post-tensioning each assembled part, the two parts are lowered towards each other until their upper ends meet at the apex, where they are then connected. The gantries are then removed for use in the erection of a further arch. If desired the arch parts may be assembled in horizontal positions, after which they are lifted into their required positions.

When each arch has been erected it must be temporarily restrained in an axial direction while the platforms and webs are constructed to form the steps between this and the previously erected arch. Suitable temporary restraint may be provided by temporary struts between the two arches. The lowermost platform on each side of the frame will be built in first, then the first vertical web, followed by the second platform, and so on to the apex of the arches. Each platform constructed provides a base for the erection of the next web and platform, and access from the area covered is not necessary. While the steps are being constructed between two arches the next arch is being erected, and when the steps are completed and any in-situ joints or other cast concrete has hardened, the temporary axial restraint provided for the intermediate arch is removed since the steps themselves will provide this arch with sufficient restraint. This arch is then used to restrain the newly erected arch and construction proceeds in this manner.

Erection of the accommodation units may commence as soon as a completed part of the frame is ready and may progress while the rest of the frame is completed. Alternatively, of course, the erection of the units may be left until the whole frame has been completed. Units will usually be erected on both sides of the frame, although one side may be left free for some other purpose such as a spectator stand for a stadium.

The accommodation units will usually be erected one to each step, although some steps may be missed if the architect so designs and some units on adjacent steps may be combined. The units may be built according to varying individual designs, or alternatively they may all be the same, but in most cases each unit will be overlapped to some extent by the unit erected on the next step up the frame, so that the storeys of the building will be generally staggered. With the preferred arrangement in which the steps are continuous up the frame, the vertical webs are the same height as the storeys and are used to form rear walls for the accommodation units which are erected to form the storeys. The platforms form part of the floors of the units, the rest of each floor being formed by the roof of the unit which is overlapped.

Access to the storeys of the building may conveniently be provided on the upper surfaces of selected arches, depending on the arrangement of the accommodation units forming the storeys. Steps, escalators or other moving surface systems, or funicular lifts may be used as desired. The various utilities which are required to serve the accommodation units may be carried by the arches, and when these are hollow (as will be common) it may be convenient to run the utilities within the cavity.

Usually, the accommodation units erected on the frame will be designed for living or office use, although shops and other public services may also be provided. The only restriction on the design and use of the accommodation units erected is the loading capacity of the frame itself. For practical reasons any industrial accommodation will usually be limited to the ground area outside the frame, provided the space is available. In this case the lowermost steps of the frame are preferably at a height above ground level greater than the vertical distance between the steps, and the accommodation units which are erected on the lowermost steps overlap a ground floor enclosure which extends alongside the frame outside the feet of the arches. Parking space for vehicles may be provided below ground level or on the roof of the ground floor accommodation. As an alternative to industrial accommodation, the ground area itself may be used to provide covered access and parking space for vehicles belonging to the occupants of the accommodation units and their visitors, and in this case the height of the ground floor enclosure is not so important. Although the heights of the storeys erected on the frame will usually be uniform, the building may be designed to have one or more storeys of a different height from the others according to the purpose of the accommodation units forming the storeys.

When the span and total height of a building in accordance with the invention are fairly great, it may be desirable to provide a road or other permanent way suspended from the frame beneath its apex. If the permanent way extends axially along the building, it may be supported by vertical members extending from the lower edges of the vertical webs of selected steps, and may be brought down to ground level at one or both ends of the building. Permanent transverse access ways may also be provided suspended beneath selected arches of the frame. These transverse ways would enable easier passage from one side of the building to the other, and may extend direct or via an axial permanent way if this is present.

Although the building will usually follow a straight line, the arches then being parallel to each other, it is nevertheless feasible for the building to follow a curve, in which case some of the arches at least will be suitably angled with respect to each other. Also, if it is desired to allow some daylight to penetrate to the ground which is spanned, the steps, and hence the accommodation units, may be terminated short of the apex of the frame in order to leave gaps between the arches at their apices.

Various embodiments of the present invention will now be described with reference to the accompanying drawings, in which.

Figure 1:
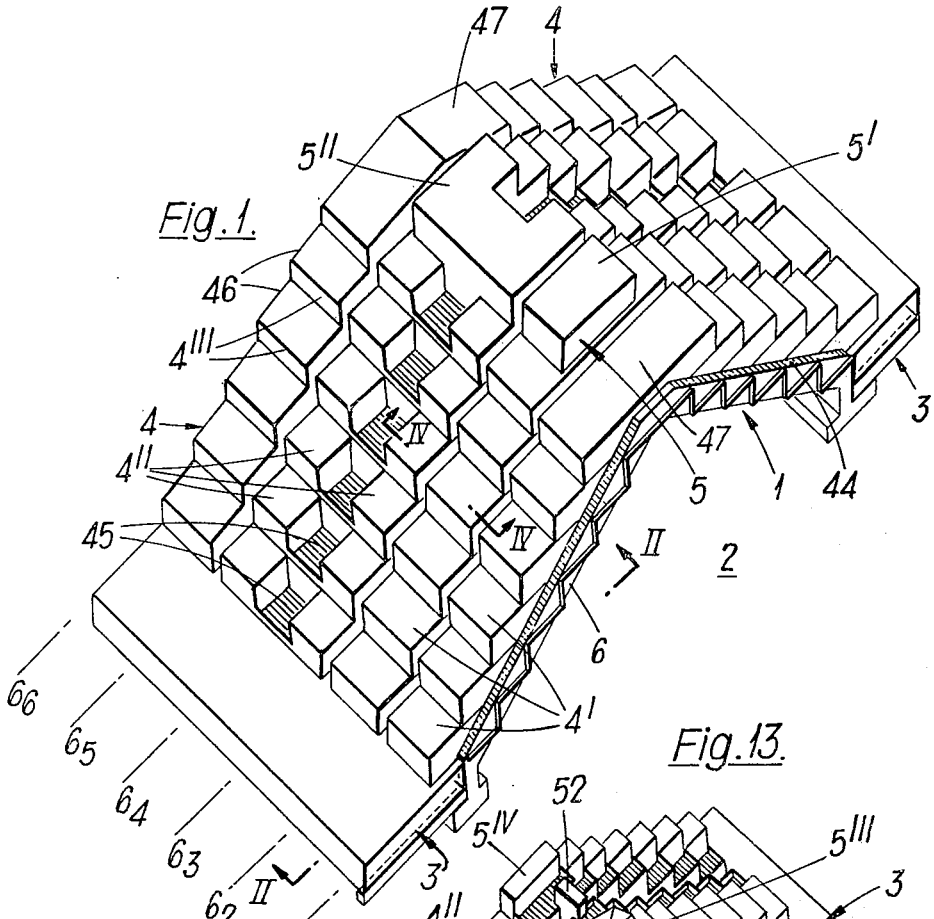
FIG. 1 is a schematic perspective view of one example of a building in accordance with the invention, illustrating some simple forms and arrangements of the accommodation units.

The building illustrated in FIG. 1 comprises a structural frame 1 having a substantially triangularly shaped profile and spans a rectangular area of ground 2 without any intermediate supports. The building has a car parking enclosure 3 erected on the ground laterally outwards of each side of the frame 1, each enclosure 3 extending along the length of the frame, and six storeys of accommodation units 4 are built on each side of the frame itself, the storeys being uniformly staggered so that the units 4 forming the sixth storey on the frame are located back to back at the apex of the frame. Further units are erected on the rooves of some of the rooves of some of the sixth storey units to form a seventh storey 5.

The structural frame 1 of the building comprises six parallel and equi-axially spaced similar concrete arches 6, (lying along the lines $6_1$ to $6_6$ in FIG. 1). Each pair of neighbouring arches support between them a pair of rising giant concrete "staircases" 7 which meet between the apices of the supporting arches 6. The frame 1 is symmetrical about the apical line of the arches and its construction is illustrated in more detail in FIG. 2 which shows half of one of the arches 6 in elevation and one of the "staircases" 7 in section.

Each arch 6 is of the three hinged type, being erected in two similar halves 6*a* and 6*b* (the latter half not being shown in FIG. 2) which are connected through a thrust bearing at the apex 8. Each foot 9 of the arch 6 is received in a suitably recessed reinforced concrete mounting block 10 which is embedded in the ground on a suitably prepared foundation (not shown). A vertically acting anti-vibration thrust bearing 11 and also a horizontally acting anti-vibration thrust bearing 12 are located between the foot 9 and its mounting block 10.

Each arch 6 has an inverted substantially V-shaped profile, having a short vertical portion at each of its foot ends 9, and straight inclined portions leading into a short horizontal portion at the apex 8. The arch is constructed so that the vertical distance S between its inclined upper and lower faces 6*u* and 6*l* is equal to the intended height of each storey of the building.

The arch halves are each constructed from a number of hollow pre-cast concrete sections, i.e. a foot section 13, a number of straight sections 14, and a head section 15, which are fixed together end to end, such as by shear connectors and grouting, and are subsequently post tensioned. A series of horizontal and vertical nibs, 16 and 17 respectively, are formed integrally on each side face of each arch half, each nib extending between the upper and lower faces 6*u* and 6*l* of its arch half. The horizontal and vertical nibs 16, 17 are arranged alternately and are continuous. The nibs are cast integrally with the arch sections 13, 14, 15, and the arrangement of the nibs on the sections is illustrated in FIG. 2, the junctions between the sections being indicated by the lines 18.

Figures 2, 5, 6:
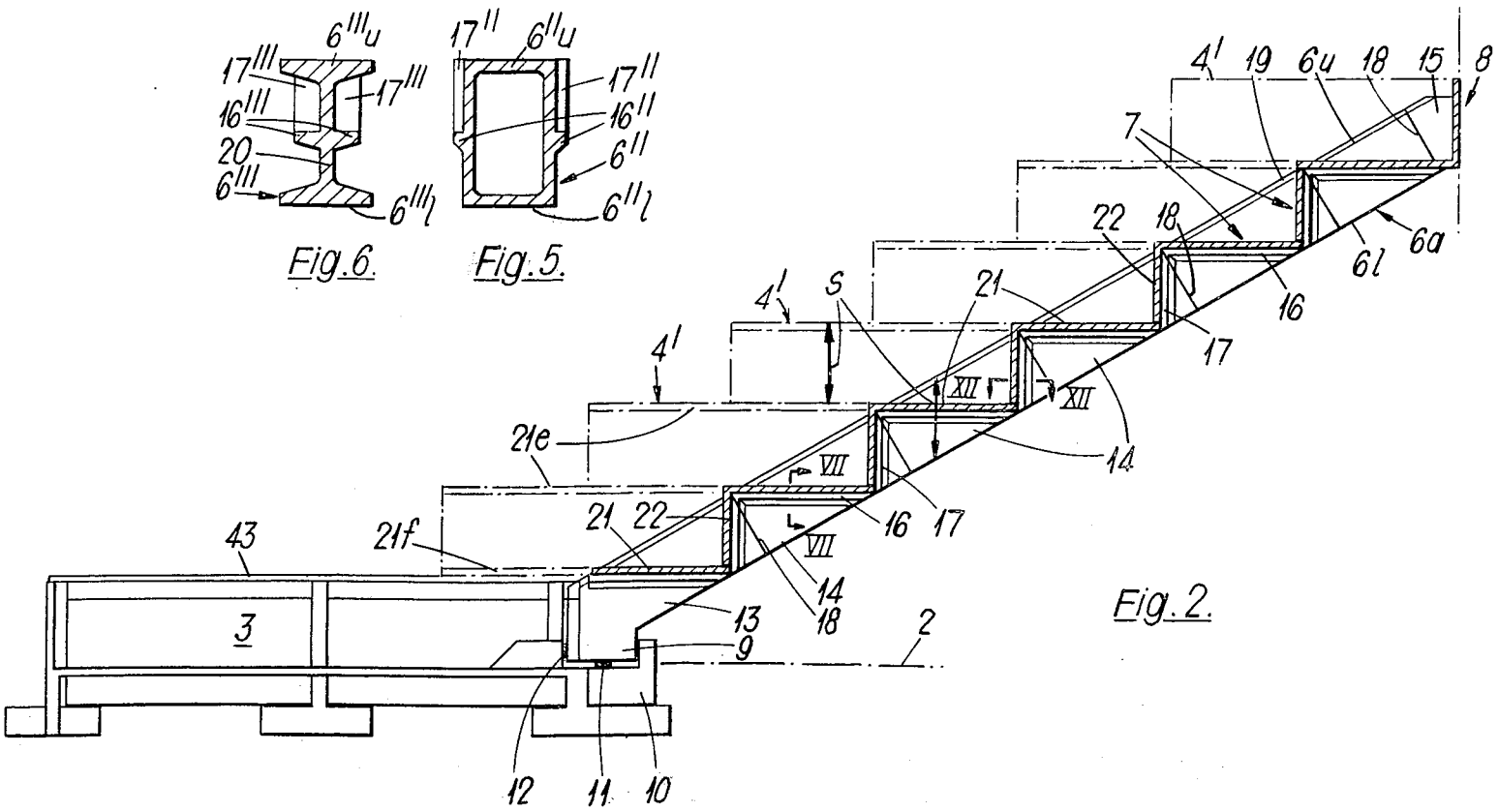
FIG. 2 is a vertical section taken on the line II—II in FIG. 1, and illustrates on a larger scale the construction of one side of the frame of the building (the other side being constructed as a mirror image about the apex), the accommodation units being shown in outline only.
FIGS. 5 and 6 are cross-sections through an alternative arch constructions to that illustrated in FIG. 4.
Figure 3:
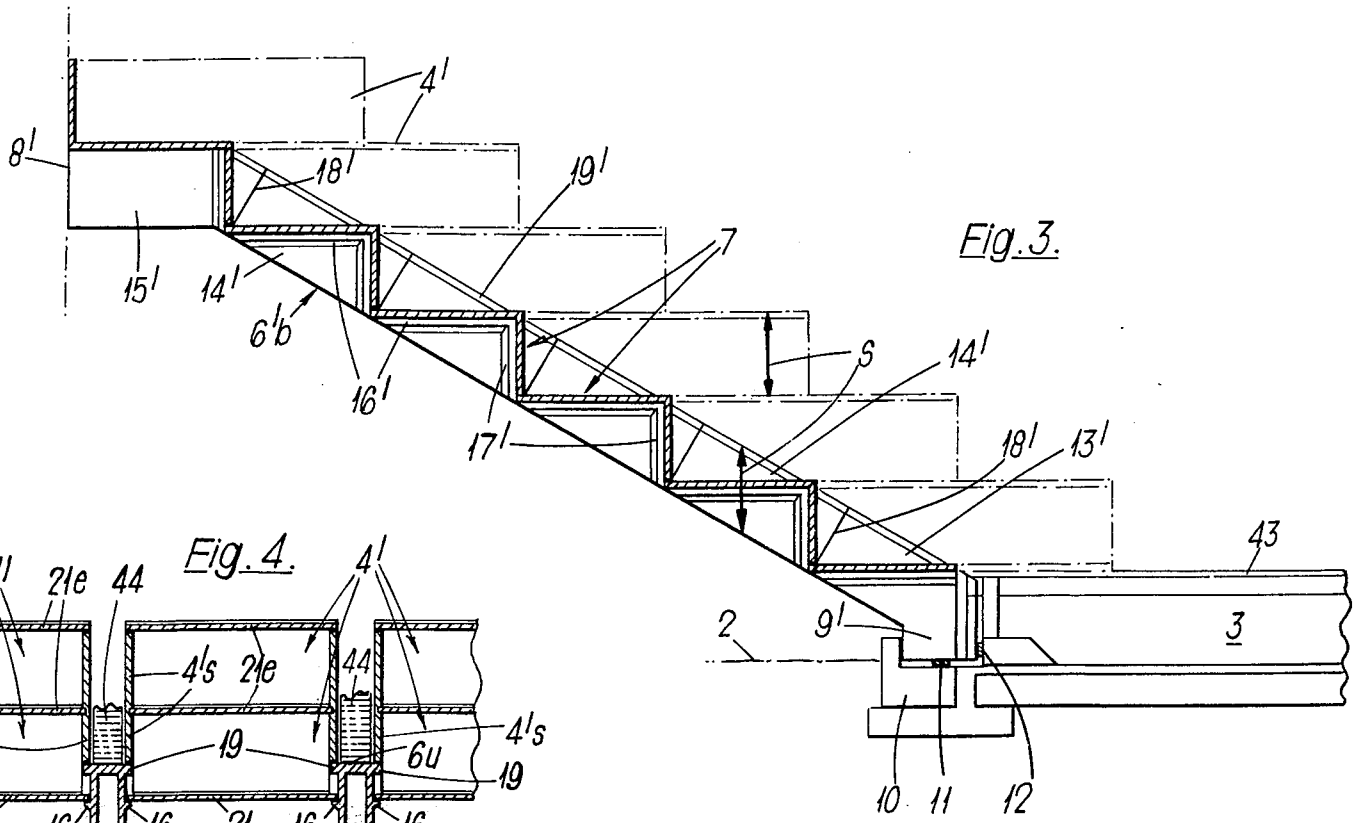
FIG. 3 is a view similar to that of FIG. 2, but shows the other side of an alternative frame construction in which the construction of the arches differs from that in FIG. 2.

An alternative arrangement of the arch sections and of their nibs is illustrated in FIG. 3, which shows the right hand half 6'*b* of an arch which is slightly different from that shown in FIG. 2. The apex of the arch 6' of FIG. 3 is lower than that of the arch 6, but frames constructed with these different arches can be used to support an exactly similar layout of storeys.

Figure 4:
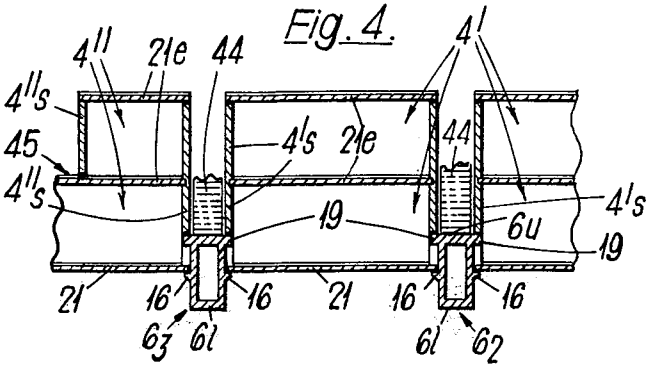
FIG. 4 is a vertical section through part of the building shown in FIG. 2, the section being taken on the line IV—IV in FIG. 1 and being drawn to a larger scale to illustrate the cross-section of the frame arches and the placement of the side walls of the accommodation units relative to the arches.

The cross section shape of each arch 6 can be seen from FIG. 4, and is substantially rectangular apart from the nibs 16, 17 which project from its side faces, and laterally projecting flanges 19 which extend along the edges of the upper face 6*u* of the arch. The cross-section of the arch 6' illustrated in FIG. 3 is the same. Alternative cross-sectional shapes for the arches are shown in FIGS. 5 and 6. In FIG. 5 a hollow arch 6'' is shown with a cross-section which is again substantially rectangular but is wider overall than that shown in FIG. 4. Horizontal and vertical nibs 16'', 17'' are still present but there are no lateral flanges 19 alongside the upper face 6''*u*. The arrangement illustrated in FIG. 6 shows an arch 6''' which is not hollow but is formed with a generally I-shaped crosssection. Horizontal and vertical nibs 16''', 17''' project integrally from the vertical centre web 20 of the section.

As can be seen from FIG. 2, each "staircase" 7 comprises a number of horizontal platforms 21 which are joined by vertical webs 22. Each platform 21 is fixed to and is supported at its ends by a pair of nibs 16 on the facing sides of the pair of arches 6 supporting the "staircase" 7, and each web 22 is fixed at its ends to a pair of nibs 17, the lower edge of the web resting on the inner edge of the platform below it. At its upper end the "staircase" 7 has a vertical web 22 which is back to back with the corresponding web of the "staircase" which is constructed between the other halves of the two arches, i.e. on the other side of the frame. These uppermost vertical webs 22 extend between the apices 8 of the arches 6, but if desired they may be dispensed with so that a double width platform is formed between the apices instead.

Figure 7:
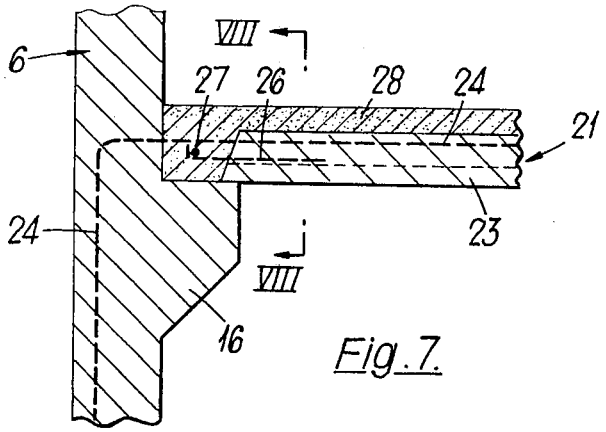
FIG. 7 is a section taken on the line VII—VII in FIG. 2 and illustrates one way of fixing the horizontal platforms of the frame steps to the arches.
Figure 8:
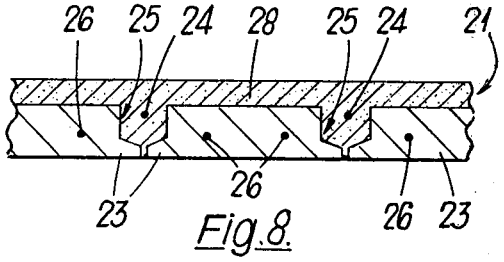
FIG. 8 is a section on the line VIII—VIII in FIG. 7 illustrating the construction of a step platform.

Each platform 21 comprises a number of pre-cast reinforced or pre-stressed concrete slabs 23 (see FIGS. 7 and 8) which are placed side by side with their ends resting on the horizontal supporting nibs 16 for the platform. At each end, the slabs 23 are arranged so that steel reinforcement bars 24 projecting from the arches 6 lie in recesses 25 between adjacent slabs. Further steel reinforcement rods 26 project from the ends of the slabs 23 and are arranged to cradle a reinforcement bar 27 which extends parallel to the ends of the slabs 23 along the length of the corresponding nib 16. A concrete deck 28 is then cast in situ over and around the slabs 23 to embed the projecting reinforcement bars 24, 26 and 27 so that the platform 21 is fixed in position.

Figure 9:
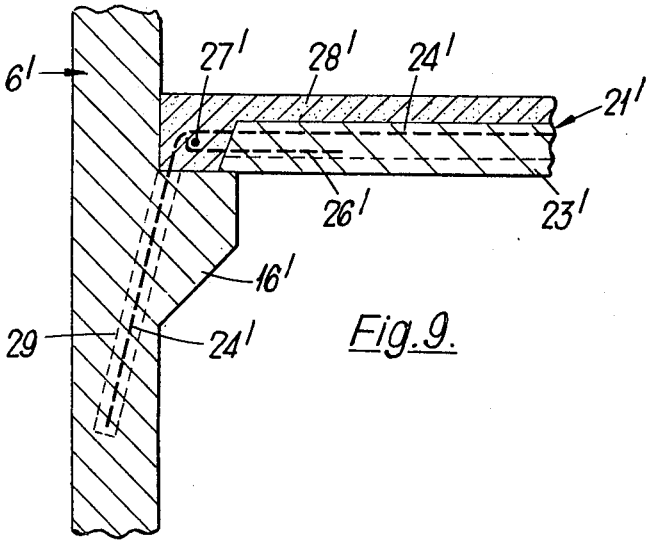
FIGS. 9 to 11 are views similar to that in FIG. 7 but illustrating alternative ways of fixing the horizontal platforms.
Figure 10:
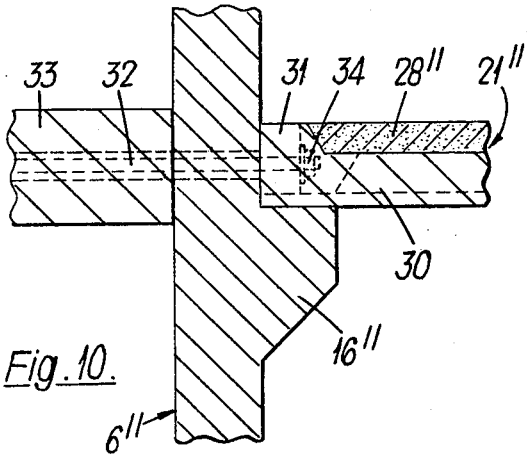
Figure 11:
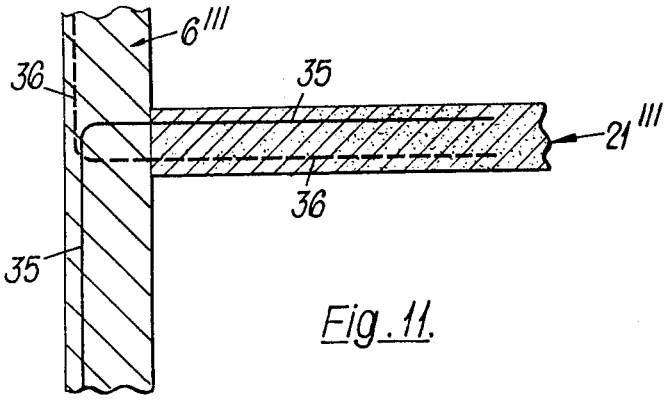

Some alternative methods of forming and fixing the platforms 21 are illustrated in FIGS. 9, 10 and 11. The method shown in FIG. 9 is very similar to that described with reference to FIGS. 7 and 8, the only difference being that the reinforcement bars 24' extending in the recesses between the platform slabs 23' are not pre-cast into the arch 6'. Instead each section of the arch 6' is provided with pockets 29 where each nib 16' projects from the side of the section, and the reinforcement bars 24' are inserted into these pockets 29. The bars 24' are grouted in the pockets 29 during erection.

The arrangement of FIG. 10 makes use of pre-cast concrete slabs 30 which are slightly different from those used in the previous methods. The slabs 30 each have a flange 31 at each of its ends, and are dimensioned so that the flanges 31 abut the sides of the arches 6'' above the support nibs 16''. The slabs 30 are held in place by bolts 32 which engage the flanges 31 and extend right through the arch 6'' to its opposite face where they engage the flanges of similar slabs which form part of the "staircase" between the next pair of arches. The passage of each bolt 32 through the arch 6'' is surrounded by a bracing sleeve 33. The view shown in FIG. 10 is symmetrical about the line X—X except for the ends of the bolt 32, the end shown in FIG. 10 carrying a nut 34 whereas the other end (not shown) would have the head of the bolt.

The method of forming the platform 21 shown in FIG. 11 is totally different. In this case the arches 6''' are not formed with support nibs on their side faces as in the previous examples, and the concrete platforms 21 are simply cast in place, using suitable shuttering, about steel reinforcement bars 35 and 36 which are pre-cast into and project from the arches 6'''. This method is not however preferred because of the greater amount of shuttering work which is necessary during construction.

Figure 12:
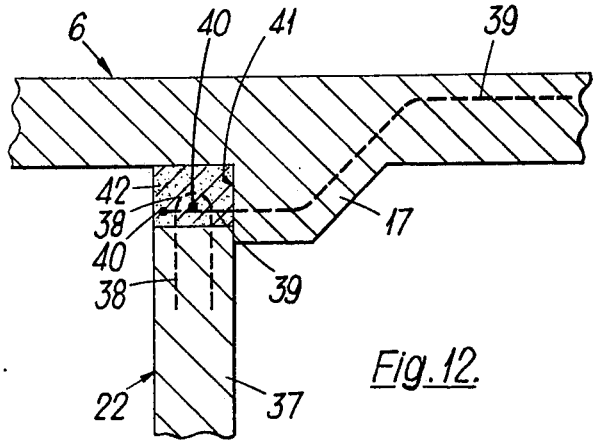
FIG. 12 is a section on the line XII—XII in FIG. 2 and illustrating one way of fixing the vertical webs of the frame steps to the arches; and, FIG. 13 is a view similar to that of FIG. 1, but on a smaller scale, and illustrates a building having a more complex arrangement of accommodation units.

Each vertical web 22 is formed by a single pre-cast concrete wall panel or slab 37 which is placed on edge along the inner edge of a platform 21 with the ends of the panel 37 abutting the vertical nibs 17 as shown in FIG. 12. If desired however, a number of smaller slabs may be used to form the panel 37 instead of one single slab. A series of steel reinforcement loops 38 project from each end of the panel 37, and these loops cooperate with a number of reinforcement bars 39, which are pre-cast into and project from the neighbouring arch 6, and also with further reinforcement bars 40 which are located in the vertical gaps 41 between the ends of the panel 37 and the arches 6. Each gap 41 is infilled with concrete 42 which envelopes the cooperating bars 38, 39 and 40 to hold the panel 37, i.e. the web 22, in position. This method of fixing the vertical webs 22 may be modified by having the reinforcement bars 39 grouted in pockets in the arches in a manner similar to that described with reference to the fixing of the platforms as shown in FIG. 9.

The ground floor car-parking enclosures 3 which are located alongside the frame 1 of the building shown in FIG. 1 are cast concrete constructions, and have their inner walls level with the inner faces of the feet 9 of the arches so that the space between the feet of neighbouring arches is used. In some cases, the enclosures 3 may project further inwards to encroach a little on the area spanned by the frame. The rooves 43 of the enclosures 3 are at the level of the lowermost horizontal support nibs 16 on the arches 6 of the frame, and this level is approximately the same height above the ground as the distance between successive nibs 16, i.e. the storey height S of the building. The accommodation units 4 which form the first storey on each side of the frame 1 are erected at the level of the lowermost platforms 21 and partially overlap the enclosures 3, extensions **21*f* of the lowermost platforms 21 being cast onto the rooves of the enclosures 3 so that with the platforms they form the floors of the first storey units. The extensions 21*f* may in fact be cast with the rooves 43 if desired. The second storey units 4 are erected at the level of the next platforms 21 upwards on each side of the frame 1 and partially overlap the first storey units. The third storey units are arranged in a similar manner relative to the second storey units, and so on up the frame 1** so that the storeys are uniformly staggered.

Each accommodation unit 4 incorporates one step of one of the "staircases" 7 of the frame 1, the vertical web 22 of the step forming the rear wall of the units, and the platform 21 forming part of its floor. The side walls on the unit 4 are constructed in any conventional manner and are supported on the flanges 19 of the adjacent arches and on the part of the floor which is formed by the roof of the unit immediately below it on the frame (see FIG. 4). The roof of the unit is formed as an extension **21*e* of the platform of the next step up the frame. As can be seen from FIG. 1, the units 4** may however take different forms, and adjacent units (both laterally and vertically) can be made communicating to provide larger accommodation areas.

A simple form of unit 4' is erected on each step between the first two pairs of arches, $6_1$ $6_2$ and $6_2$ $6_3$ of the building shown in FIG. 1. Each unit 4' is illustrated further in FIGS. 2 and 4 and is cuboid, extends across the whole of its step, and is built outwards from the step to double the width of the step so that the rear half of the unit 4' is overlapped by the front half of the unit 4' on the next upward step. The side walls of units 4' are shown at **4'*s* in FIG. 4. Access to the units 4' in the different storeys of the building is gained by means of stairs 44 (FIGS. 1 and 4) which are formed on the upper surfaces 6*u* of the first and second arches $6_1$ and $6_2$ in the frame 1**.

A different form of accommodation unit 4'' is erected on each step between the next two pairs of arches $6_3$ $6_4$ and $6_4$ $6_5$. Each unit 4'' is L-shaped and is arranged so that the adjacent two units 4'' in each storey communicate with each other across the arch $6_4$ to provide a double unit which is symmetrical about the plane of the arch $6_4$. The side wings of each double unit overlap the units 4'' of the storey below and border a patio 45 which is formed on part of the rooves of the lower units 4''. The units 4'' may however remain divided despite being joined across the arch $6_4$, and in this case the patios 45 would also be divided in the plane of the arch $6_4$ by small fences (not shown). On the steps between the last pair of arches $6_5$ $6_6$ accommodation units 4''' are erected in the same way as the units 4' between the first two pairs of arches, but in this case the exposed roof part 46 of each unit 4''' is inclined upwards towards the next unit. Further sets of stairs 44 are formed on the upper surfaces of the third and fifth arches $6_3$ and $6_5$ for providing access to the units 4'' and 4''' in the different storeys. The rooves of the sixth storey units 4' between the first pair of arches $6_1$ $6_2$ and the units 4''' between the last pair of arches $6_5$ $6_6$ are clear as shown at 47. The rooves of the sixth storey units 4' and 4'' between the other arches are used however to support seventh storey units 5' and 5'' as shown.

Figure 13:
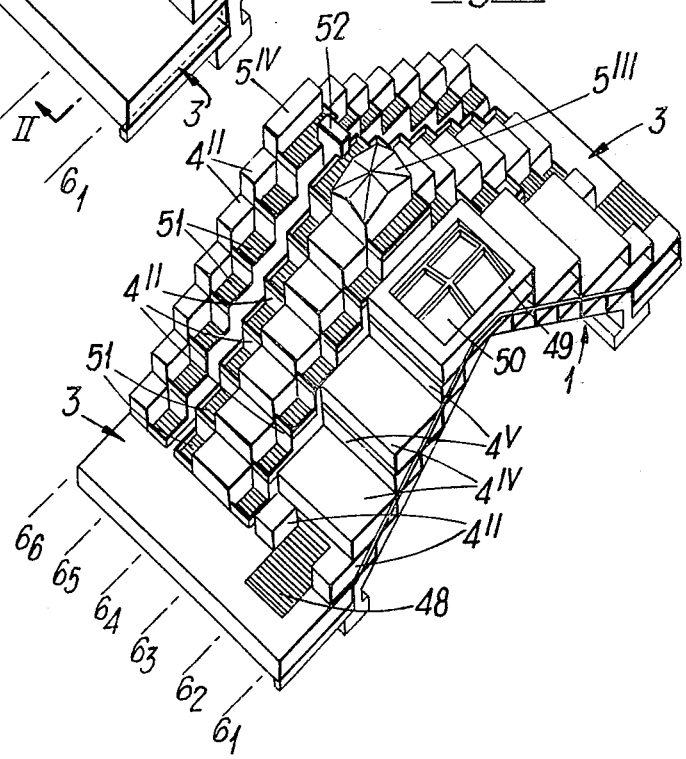

Further forms and arrangements of units 4 are used in the building illustrated in FIG. 13. In this example the structural frame is exactly the same as that described with reference to the building in FIG. 1, the building extending across six parallel arches lying on the lines $6_1$ to $6_6$ and the building also including a ground floor car parking enclosure 3 along each side of the frame. The building is symmetrical about its apical line.

The units 4 erected on the steps between the first two pairs of arches of the frame are joined over the upper surface of the common arch $6_2$, but the form of the units varies from storey to storey. In the first storey the units are L-shaped and are arranged similarly to the units 4'' described in FIG. 1, their side wings and common patio 48 overlapping the roof of the enclosure 3. In the second storey the units are similar to the units 4' described in FIG. 1 but are combined to form a large cuboid enclosure $4^{IV}$ which overlaps the rear of the first storey double unit 4''. The third storey units are restricted to the area of their steps but combine across the arch 62 to form a cuboid enclosure $4^V$ which does not overlap the second storey at all. The fourth and fifth storeys correspond to the second and third storeys respectively, the fourth storey overlapping the whole of the enclosure $4^V$ in the third storey. The units in the sixth storey form enclosures similar to those in the second and fourth storeys, but the sixth storey enclosures on the two sides of the frame are combined at the apex of the frame to form a very large penthouse enclosure 49. This is provided with a glazed roof 50.

The units erected on the steps between the next two pairs of arches $6_3$ $6_4$ and $6_4$ $6_5$ are each L-shaped and are similar to those 4'' described in FIG. 1. The units 4'' in the present example are joined across the arch $6_4$ but are arranged back to back so that the patios 51 of the two adjoining units in each storey are separated from each other by the units themselves. A further enclosure 5''' is erected on the rooves of the sixth storey units 4'' which are joined back to back at the apex of the frame. Similar units 4'' are erected on the steps between the last pair of arches $6_5$ $6_6$ are arranged with their patios 51 facing the arch $6_5$. An enclosure $5^{IV}$ is erected on the rooves of the sixth storey units. Access to the storeys is provided by stairs (not shown) on the upper surfaces of the first and third arches $6_1$ and $6_3$, and by means of a lift, part of which is shown at 52, on the fifth arch $6_5$.

We claim:

1. A method of building a multi-story structure over an area on which it is not desired or not possible to build directly, comprising the steps of erecting a plurality of arches spanning said area without intermediate support, said arches having vertical side walls between sloping upper and lower surfaces and being pitched so that the distance between said upper and lower surfaces of said arches, measured vertically, defines the height of each storey of said structure, erecting a plurality of horizontal platforms and vertical webs between each pair of said arches in alternating and continuous manner to form a series of staggered steps between said pair of arches on at least one side of the apices of said arches for carrying the storeys of said structure, the height of each of said vertical webs being equal to the storey height of said structure, fixing said horizontal platforms and said vertical webs to said side walls of said arches adjacent said platforms and said webs, erecting an accommodation unit having a floor, a plurality of walls, and a roof on a lowest of said steps using said vertical web of said lowest step to provide one of said walls of said unit, said platform of said lowest step to provide at least part of said floor of said unit, and the facing side walls of said arches adjacent said lowest step to provide part of two more of said walls of said unit, and erecting further accommodation units in similar fashion on others of said steps to form the storeys of said structure, whereby said accommodation units are keyed into and integral with said structure and said structure is monolithic.

2. A method as claimed in claim 1, wherein first and second of said arches are erected, a first series of said staggered steps is erected and fixed between said first and second arches, a third of said arches is erected axially spaced from said second arch, a second series of staggered steps is erected and fixed between said second and said third arches, and so on.

3. A method as claimed in claim 1, wherein the step of erecting said arches includes the steps of suspending a temporary support across said area, using said temporary support to support and position prefabricated sections for forming a first of said arches, fixing together said prefabricated sections to form said first arch, shifting said temporary support into position for erecting a second of said arches, and so on.

4. A method as claimed in claim 1, wherein the steps of erecting and fixing each of said series of staggered steps comprises positioning and fixing said horizontal platforms and said vertical webs of said steps in ascending order whereby each erected platform provides a working support for the erection of the next vertical web and the next horizontal platform.

5. A method as claimed in claim 1, including the step of providing means on said upper surface of at least every alternate arch for enabling access to said storeys of said structure.

6. A method as claimed in claim 1, wherein the step of erecting said accommodation units includes the step of using part of said roof of each of said accommodation units in forming part of said floor of said next accommodation unit up said structure, whereby said storeys of said structure overlap.

7. A monolithic multi-storey building over an area on which it is not desired or not possible to build directly, comprising a load bearing frame having an inverted substantially V-shaped profile and spanning said area without intermediate support, and a plurality of accommodation units, each of said units including a floor, a plurality of walls, and a roof, erected on said frame in a staggered formation towards the apex of said frame to form the storeys of said building, said frame consisting of a plurality of axially spaced arches, said arches having sloping upper and lower surfaces and vertical side walls between said upper and lower surfaces, pitched so that the distance between said upper and lower surfaces of said arches, measured vertically, is equal to the height of each of said storeys of said building, and the weight of said building is supported substantially wholly by said arches, a plurality of horizontal platforms and vertical webs extending between each pair of said arches in alternating and continuous manner to form a series of staggered steps between said pair of arches on at least one side of the apices of said arches, the height of each of said vertical webs being equal to the storey height of said building, and means fixedly mounting said platforms and said webs on said side walls of said arches adjacent said platforms and said webs, each of said accommodation units being erected on one of said steps with said vertical web of said step providing one of said walls of said unit, said platform of said step providing at least part of said floor of said unit, and said side walls of said arches adjacent said step providing part of two more of said walls of said unit, whereby said accommodation units are keyed into and are integral with said frame.

8. A building as claimed in claim 7, wherein said horizontal platforms and said vertical webs comprise reinforced precast concrete slabs.

9. A building as claimed in claim 7, wherein each of said arches is of concrete construction, is formed in two parts which are post tensioned, and includes means connecting said two parts together at the apex, each of said two parts including a plurality of precast sections and means fixing said sections end to end.

10. A building as claimed in claim 7, wherein access means to said accommodation units of said storeys is constructed on said upper surface of at least every alternate arch of said arches.

11. A building as claimed in claim 7, wherein said arches are hollow and utility services for said accommodation units are carried in said hollow arches.

12. A building as claimed in claim 7, wherein part of said roof of each of said accommodation units forms part of said floor of said accommodation unit immediately above in the next storey of said building, whereby said storeys overlap one another.

13. A building as claimed in claim 12, including a ground floor enclosure extending along each side of said frame outside of said area spanned by said frame, and wherein said accommodation units which are erected on the lower most steps of said frame overlap said ground floor enclosures.

14. A building as claimed in claim 13, wherein said ground floor enclosures are of a height greater than that of each of said storeys erected on said frame.

* * * * *